United States Patent [19]

Tanaka et al.

[11] 4,029,063

[45] June 14, 1977

[54] INTAKE APPARATUS FOR INTERNAL COMBUSTION ENGINE

[75] Inventors: Minoru Tanaka, Chofu; Sakuji Arai, Wako, both of Japan

[73] Assignee: Honda Giken Kogyo Kabushiki Kaisha, Tokyo, Japan

[22] Filed: Apr. 16, 1976

[21] Appl. No.: 677,670

[30] Foreign Application Priority Data

Apr. 24, 1975 Japan ..... 50-49088

[52] U.S. Cl. ..... 123/52 M

[51] Int. Cl.[2] ..... F02B 75/18

[58] Field of Search ..... 123/52 M, 52 MB, 52 NC, 123/59 R

[56] References Cited

UNITED STATES PATENTS

| | | | |
|---|---|---|---|
| 1,632,880 | 6/1927 | Burtnett | 123/52 MB |
| 2,043,079 | 6/1936 | Timian | 123/52 M |

*Primary Examiner*—Edgar W. Geoghegan

*Attorney, Agent, or Firm*—Lyon & Lyon

[57] ABSTRACT

Unequal fuel concentrations in air-fuel mixtures delivered by a downdraft carburetor to branched intake pipes leading to engine cylinders has been traced to asymmetrical fuel delivery into the venturi passage in the carburetor. To equalize the fuel concentrations carried in the branched pipes, an inclined wall is provided in the distribution chamber that receives the air-fuel mixture from the carburetor. The inclination of the wall directs a greater quantity of air-fuel mixture into the branched pipe which would otherwise receive a leaner mixture because of the asymmetrical distribution of fuel from the venturi passage.

3 Claims, 3 Drawing Figures

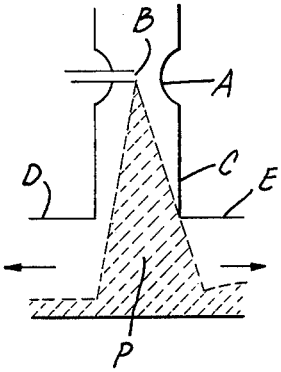
FIG. 1.
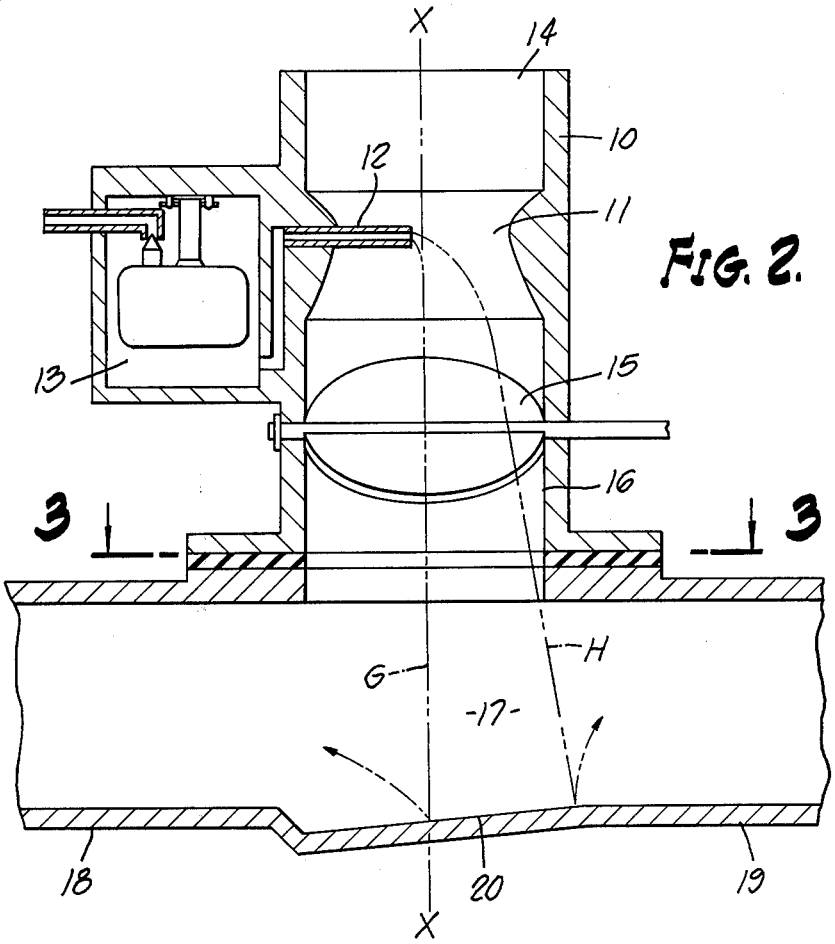
FIG. 2.
FIG. 3.
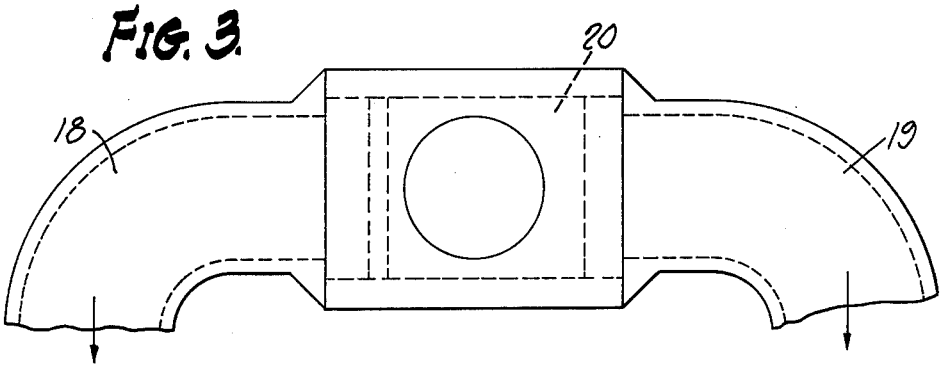

INTAKE APPARATUS FOR INTERNAL COMBUSTION ENGINE

This invention relates to intake pipe systems for internal combustion piston engines having a plurality of cylinders.

Conventional carburetors of the downdraft type have employed a venturi passage having a substantially vertical axis, together with a fuel nozzle which projects into the venturi passage in a direction at right angles to that axis. It has been found that the fuel delivered into the air stream traveling through the verturi passage is not uniformly distributed, but on the contrary the fuel tends to continue to move with a component of motion in a direction parallel to the direction of the fuel emerging from the fuel nozzle. When branched intake pipes extending in opposite directions receive such an air-fuel mixture with asymmetrical distribution, one of the branched intake pipes receives a comparatively rich fuel concentration of air-fuel mixture, and the other branched intake pipe receives a comparatively lean fuel concentration of air-fuel mixture. If the engine is constructed to operate with a mixture so lean as to be close to the combustibility limit, the unequal concentration of air-fuel mixture may well result in an increase of NOx in the exhaust gas discharged from the cylinders which receive a too rich mixture, and a development of a misfire and an increase of CO and HC in the exhaust gas discharged from the cylinders which receive a mixture which is too lean. Further it may result in an unevenness in the output between the cylinders to produce a vibration in the engine.

In accordance with this invention, the air-fuel mixture from the carburetor is caused to impinge upon a wall of a distribution chamber from which intake pipes extend in opposite directions to supply air-fuel mixture to the cylinders. The wall is inclined to the axis of the venturi passage so as to increase the concentration of fuel supplied to one of the branch pipes and to reduce the fuel concentration supplied to the other branch pipe, and in this way to equalize the fuel concentration in both of the branch pipes.

Other and more detailed objects and advantages will appear hereinafter.

In the drawings:

FIG. 1 shows a conventional apparatus in diagrammatic form.

FIG. 2 is a sectional elevation showing a preferred embodiment of this invention.

FIG. 3 is a plan view, partly broken away, taken substantially on the lines 3—3 as shown in FIG. 2.

Referring to the drawings, the conventional device shown diagrammatically in FIG. 1 employs a carburetor having a venturi passage A into which a fuel nozzle B projects. The air-fuel mixture thus created in the verturi passage A moves downward through passage C and then moves laterally in opposite directions through the branched intake pipes D and E for delivery to the cylinders of the engine.

It has now been discovered that the pattern of air-fuel mixture shown in the shaded area P of FIG. 1 is asymmetrical because the fuel emerging from the nozzle B tends to move with a component of motion in a direction parallel to the fuel nozzle. Accordingly, the branched intake pipe E receives a greater concentration of fuel than the branched pipe D, and this may lead to an increase of pollutants $NO_x$, HC and CO in the exhaust gases, as described above. Also, the engine operation may tend toward roughness because of unequal forces acting on the pistons.

It has been found that these difficulties may be reduced by apparatus of the type shown in FIGS. 2 and 3. The carburetor 10 is provided with a venturi passage 11 having an axis X—X which is substantially vertical. A fuel nozzle 12 projects into the venturi passage 11 at right angles to the axis X—X. This fuel nozzle 12 is fed from the usual float chamber 13. Air inducted through the inlet 14 moves through the venturi passage 11 and causes liquid fuel to pass through the nozzle 12 and to mix with the air. The air-fuel mixture passes the throttle valve 15 as it flows through the carburetor passage 16 and into the distribution chamber 17. Branched intake pipes 18 and 19 extend in opposite directions from the distribution chamber 17. The phantom lines G and H are intended to show that the fuel concentration delivered from the carburetor 10 into the distribution chamber 17 is asymmetrical, with the richer portion moving toward the intake pipe 19.

In order to compensate for this asymmetrical distribution of fuel in the air-fuel mixture delivered to the distribution chamber 17, one wall 20 of the distribution chamber 17 is inclined with respect to the axis X—X of the venturi passage 11. The inclination or slope of the wall 20 is such that it is higher near the branched intake pipe 19 and lower near the branched intake pipe 18. Since the flow of air-fuel mixture from the carburetor 10 impinges on this wall 20, the inclination thereof is made sufficiently steep to direct a greater quantity of air-fuel mixture into the branched intake pipe 18, as compared to the quantity moving into the branched intake pipe 19. The effect is to compensate for the richer mixture which passes into the branched intake pipe 19 and to equalize the flow rate of fuel into the two branched intake passages. There is no relation between the direction of the fuel nozzle and the direction of the vehicle body on which the engine is mounted.

Having fully described our invention, it is to be understood that we are not to be limited to the detail herein set forth but that our invention is of the full scope of the appended claims.

We claim:

1. Apparatus for delivering an air-fuel mixture to an internal combustion engine having a plurality of cylinders, comprising: a carburetor having a venturi passage with a substantially vertical axis, a fuel nozzle projecting into the venturi passage at right angles to said axis, a distribution chamber receiving an air-fuel mixture generated in said venturi passage, a first branch pipe leading from said distribution chamber in one direction for supplying air-fuel mixture to one of the engine cylinders, a second branch pipe leading from said distribution chamber in the opposite direction for supplying air-fuel mixture to another cylinder of the engine, said distribution chamber having a wall remote from said carburetor against which the air-fuel mixture from the carburetor impinges, said wall being inclined with respect to said axis to equalize fuel concentrations in the air-fuel mixtures delivered to each of said branch pipes.

2. The device of claim 1 in which the fuel nozzle is oriented so that a greater pro portion of fuel is directed toward one of said branch pipes, the inclination of said wall tending to increase the fuel concentration delivered to the other of said branch pipes.

3. Apparatus for delivering an air-fuel mixture to an internal combustion engine having a plurality of cylinders, comprising: a carburetor having a venturi passage with a substantially vertical axis, a fuel nozzle projecting into the venturi passage at right angles to said axis, a distribution chamber receiving an air-fuel mixture generated in said venturi passage, a first branch pipe leading from said distribution chamber in a direction parallel to the direction of said fuel nozzle for supplying air-fuel mixture to one of the engine cylinders, a second branch pipe leading from said distribution chamber in the opposite direction for supplying air-fuel mixture to another cylinder of the engine, said distribution chamber having a wall remote from said carburetor against which the air-fuel mixture from the carburetor impinges, said wall being inclined with respect to said axis and having a lower portion adjacent said second branch pipe in order to increase the fuel concentration in the air-fuel mixtures delivered to said second branch pipe.

* * * * *